US007758182B2

(12) United States Patent
Yonekawa

(10) Patent No.: US 7,758,182 B2
(45) Date of Patent: Jul. 20, 2010

(54) IMAGE FORMING APPARATUS WITH MULTIPLE DOORS

(75) Inventor: Masahiro Yonekawa, Tokyo-to (JP)

(73) Assignee: Ricoh Company, Ltd., Tokyo (JP)

( * ) Notice: Subject to any disclaimer, the term of this patent is extended or adjusted under 35 U.S.C. 154(b) by 152 days.

(21) Appl. No.: 11/614,796

(22) Filed: Dec. 21, 2006

(65) Prior Publication Data

US 2007/0139506 A1 Jun. 21, 2007

(30) Foreign Application Priority Data

Dec. 21, 2005 (JP) ..... 2005-367510

(51) Int. Cl.
*B41J 29/13* (2006.01)

(52) U.S. Cl. ..... 347/108

(58) Field of Classification Search ..... 347/108, 347/152, 222; 271/162–164, 171; 399/107, 399/110, 123, 124
See application file for complete search history.

(56) References Cited

U.S. PATENT DOCUMENTS

| | | | | |
|---|---|---|---|---|
| 4,873,541 | A * | 10/1989 | Hirose et al. | 347/118 |
| 5,134,443 | A * | 7/1992 | Sumi et al. | 399/121 |
| 5,915,157 | A | 6/1999 | Takenaka et al. | |
| 5,930,561 | A | 7/1999 | Hosokawa et al. | |
| 6,057,936 | A | 5/2000 | Obara et al. | |
| 6,128,455 | A * | 10/2000 | Horiguchi et al. | 399/124 |
| 6,131,902 | A | 10/2000 | Takenaka et al. | |
| 6,507,720 | B2 | 1/2003 | Kabumoto et al. | |
| 7,380,931 | B2 * | 6/2008 | Asanuma | 347/108 |
| 2002/0043910 | A1 | 4/2002 | Hashimoto et al. | |
| 2004/0051769 | A1 * | 3/2004 | Tsusaka et al. | 347/108 |
| 2007/0140731 | A1 * | 6/2007 | Yonekawa | 399/107 |

FOREIGN PATENT DOCUMENTS

| | | |
|---|---|---|
| JP | 8-30178 | 2/1996 |

OTHER PUBLICATIONS

U.S. Appl. No. 11/935,775, filed Nov. 6, 2007, Yonekawa.

* cited by examiner

*Primary Examiner*—Stephen D Meier
*Assistant Examiner*—Geoffrey Mruk
(74) *Attorney, Agent, or Firm*—Oblon, Spivak, McClelland, Maier & Neustadt, L.L.P.

(57) ABSTRACT

An image forming apparatus for forming an image on a recording medium includes a main unit, a first door, and a second door. The main unit includes an image forming mechanism to form an image and a replaceable component to be ordinarily replaced by a user. The first door is arranged at a first part of a front side of the main unit. The first door is openable and closable. The second door is arranged at a second part of the front side of the main unit to vertically divide the front side of the main unit such that the first door and the second door do not overlap in a vertical direction. The second door is difficult to attach and detach to and from the main unit.

11 Claims, 6 Drawing Sheets

IMAGE FORMING APPARATUS WITH MULTIPLE DOORS

BACKGROUND OF THE INVENTION

1. Field of the Invention

The present invention relates to an image forming apparatus, and more particularly to an image forming apparatus such as an ink jet recording apparatus having two openable and closable doors at a front side thereof.

2. Discussion of the Background

A background ink jet recording apparatus such as an ink jet printer is mainly provided for personal use, unlike an image forming apparatus utilizing an electorophotographic method. Therefore, there has been demand for a reduction in size of the background ink jet recording apparatus and for a reduction in the space required for installing the background ink jet recording apparatus. In response, various changes have been made in the configurations of ink jet recording apparatuses.

Recently, the background ink jet recording apparatus has attracted attention because the background ink jet recording apparatus may take the place of a conventional electorophotographic printer. However, the background ink jet recording apparatuses have had the same appearance as conventional electorophotographic printers.

The size of an image forming unit of the background ink jet recording apparatus is considerably smaller than the size of an image forming unit of the conventional electorophotographic printer. When a user opens a front door of the background ink jet recording apparatus, which is configured to be able to fully open a front face of the background ink jet recording apparatus, a user may easily access the image forming unit therein.

Although the user needs to be able to perform a jam clearance operation and replacement of an ink cartridge, the user needs to be prevented from easily accessing the image forming unit.

SUMMARY OF THE INVENTION

This patent specification describes an image forming apparatus for forming an image on a recording medium, including a main unit that includes an image forming mechanism for forming an image and a replaceable component ordinarily replaced by a user, a first door arranged at a first part of a front side of the main unit, wherein the first door is configured to be openable and closable, and a second door arranged at a second part of the front side of the main unit, wherein the second door is configured such that it is difficult to attach and detach the second door to and from the main unit.

Also described is an image forming apparatus for forming an image on a recording medium, including a main unit, a service means, and a maintenance means. The main unit includes an image forming mechanism configured to form an image and a replaceable component configured to be ordinarily replaced by a user. The service means allows access to the replaceable component, is arranged at a first part of a front side of the main unit, and is configured to be openable and closable. The maintenance means prevents access to the image forming mechanism arranged at a second part of the front side of the main unit, and is configured such that it is difficult to attach and detach the maintenance means to and from the main unit.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
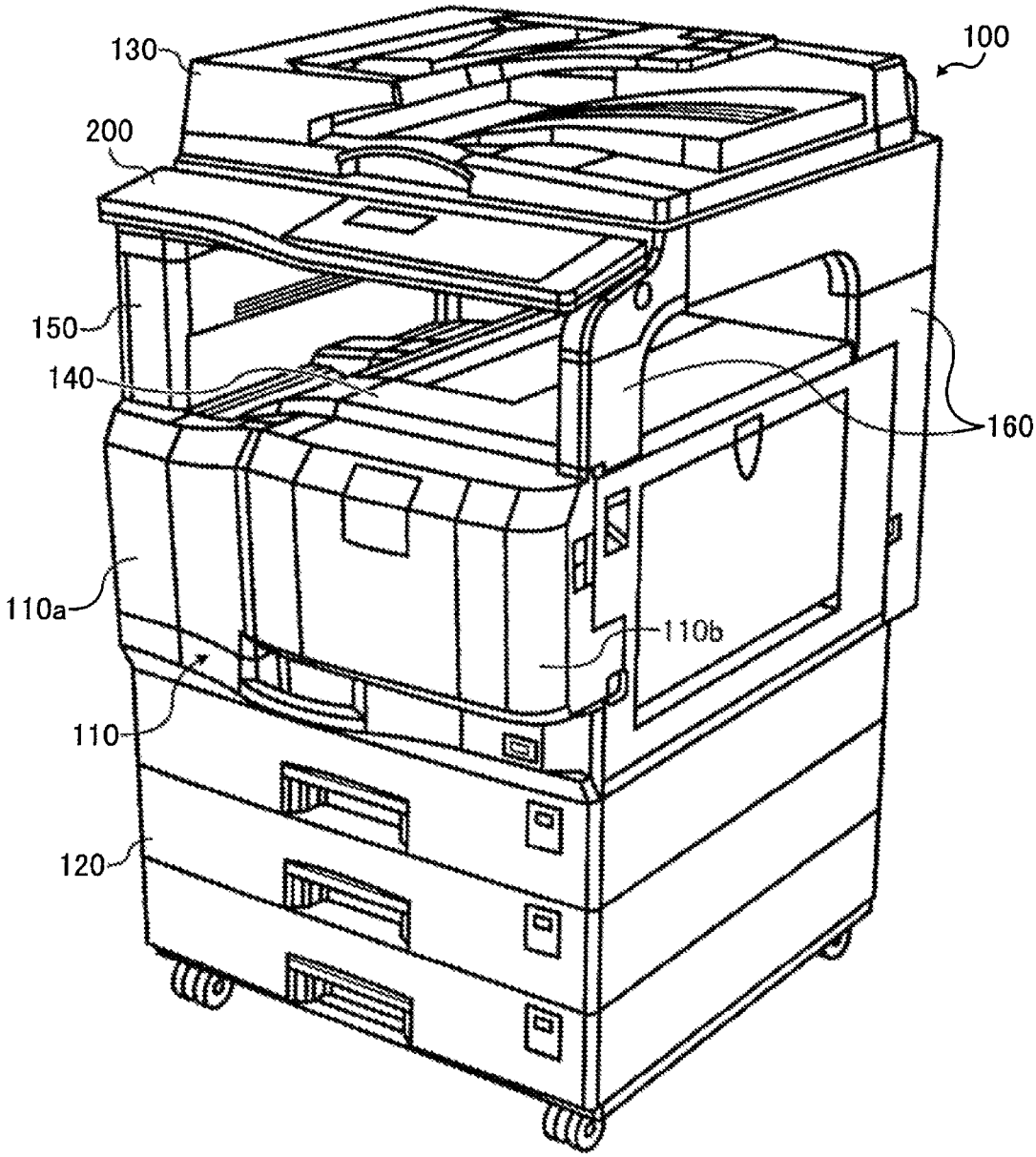
FIG. 1 is a perspective view illustrating an entire configuration of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus according to an exemplary embodiment of the present invention is described.

FIG. 1 is a perspective view illustrating an entire configuration of an image forming apparatus 100 according to an exemplary embodiment of the present invention. The image forming apparatus 100 adopts a gel ink jet method, and discharges a recording sheet inside a main unit thereof.

As shown in FIG. 1, the image forming apparatus 100 includes an image forming section 110, an optional sheet feeding section 120, an image scanning unit 130, a sheet discharge unit 140, connecting sections 150 and 160, and an operation unit 200.

The image forming section 110 is located in a middle area of the image forming apparatus 100. The optional sheet feeding section 120 is located below the image forming section 110, and includes four sheet feeding trays. The image scanning unit 130 is located above the image forming section 110. The sheet discharge unit 140 is located between the image forming section 110 and the image scanning unit 130. The connecting section 150 connects the image forming unit 110 and the image scanning unit 130 at respective front left sides and respective back left sides thereof as shown in FIG. 1. The connecting section 160 connects the image forming unit 110 and the image scanning unit 130 at respective front right sides and respective back right sides thereof as shown in FIG. 1. The operation unit 200 is located above the image forming section 110, and in an upper front area of the image scanning unit 130.

Figure 2:
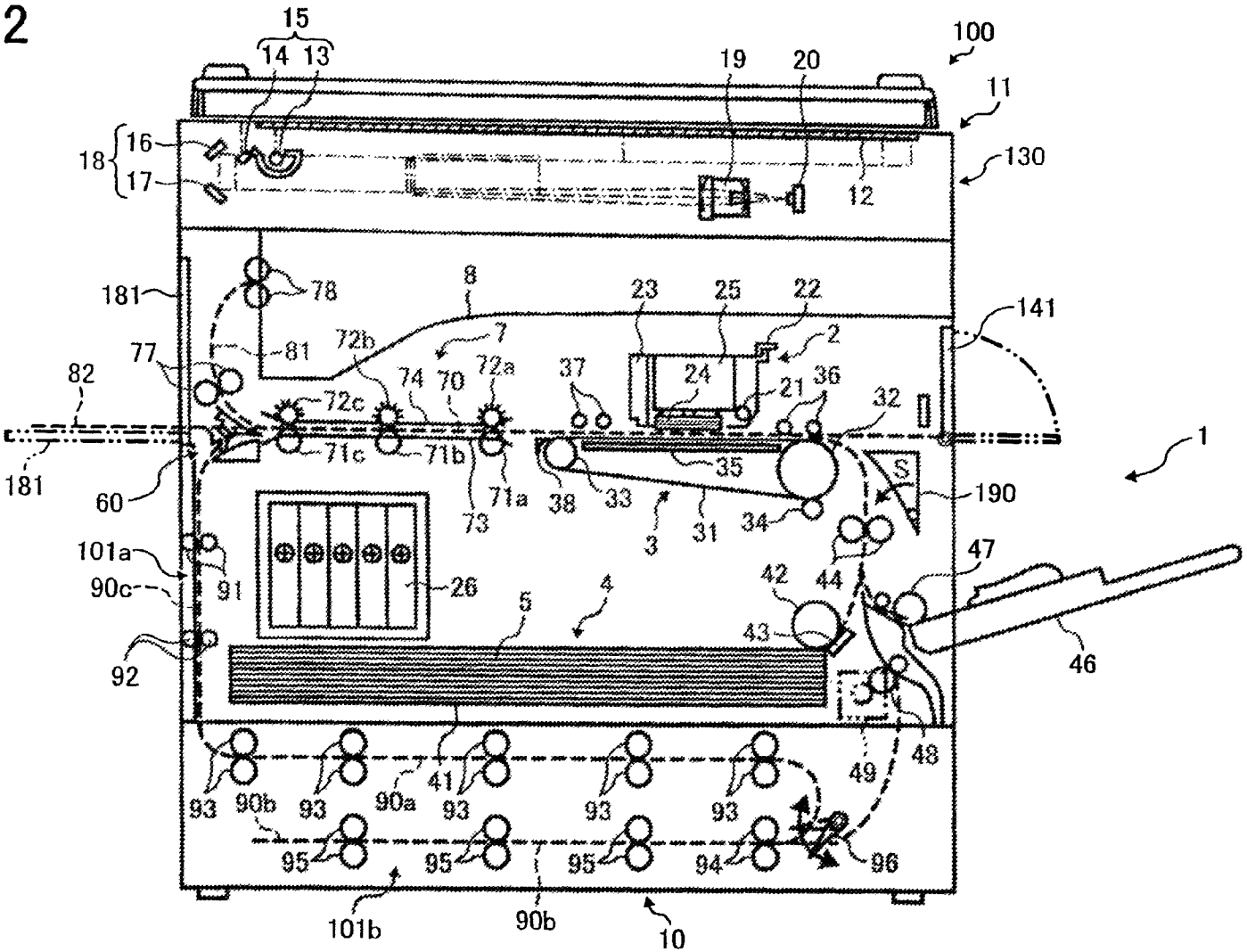
FIG. 2 is a schematic illustration of a main unit and an image scanning unit of the image forming apparatus shown in FIG. 1.

The image forming apparatus 100 further includes a main unit 1 having an image forming unit 2 and a sub-scanning conveyance unit 3, as shown in FIG. 2.

FIG. 2 is a schematic illustration of the main unit 1 and the image scanning unit 130 of the image forming apparatus 100.

Figure 3:
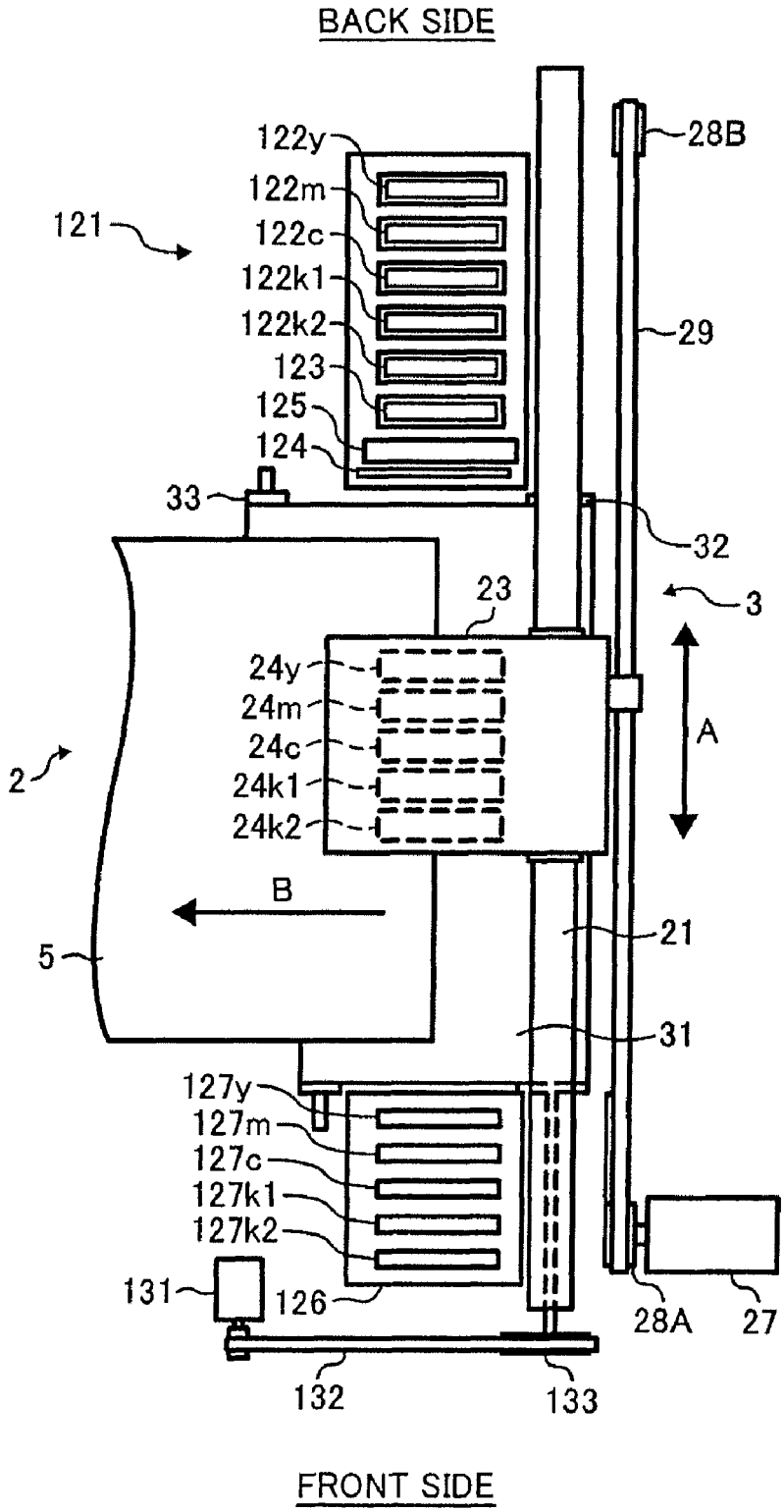
FIG. 3 is a plan view of an image forming unit and a sub-scanning conveyance unit in the main unit of the image forming apparatus shown in FIG. 1.

FIG. 3 is a plan view of the image forming unit 2 and the sub-scanning conveyance unit 3 located in the main unit 1 of the image forming apparatus 100.

The image forming apparatus 100 shown in FIG. 2 further includes a sheet feeding unit 4, a sheet conveyance unit 7, and a sheet discharge tray 8. The image forming apparatus 100 optionally includes a duplex unit 10.

The sub-scanning conveyance unit 3 conveys a sheet 5 sequentially fed from the sheet feeding unit 4 having a sheet feeding cassette located at the bottom of the main unit 1. The image forming unit 2 discharges ink droplets onto the sheet 5 to form an image while the sheet 5 is conveyed by the sub-scanning conveyance unit 3. In single-sided image forming, the sheet 5 is discharged through the sheet conveyance unit 7 onto the sheet discharge tray 8 arranged on a top face of the main unit 1. In double-sided image forming, the sheet 5 conveyed in the sheet conveyance unit 7 is sent into the duplex unit 10 located below the main unit 1. The sheet 5 sent into the duplex unit 10 is switched back, and is again supplied to the sub-scanning conveyance unit 3 so that image forming is performed on another side of the sheet 5 and discharged onto the sheet discharge tray 8.

The image scanning unit 130 includes a scanner unit 11. The scanning unit 11 includes an exposure glass 12, an optical scanning system 15 having a light source 13 and a mirror 14, another optical scanning system 18 having mirrors 16 and 17, a lens 19, and an image reading element 20.

The image scanning unit 130 is an input system for obtaining image data (i.e. print data) of an image to be formed by the image forming unit 2. In the scanner unit 11 of the image scanning unit 130, the optical scanning systems 15 and 18 scan an image of an original set on the exposure glass 12. The scanned image of the original is read by the image reading element 20 arranged behind the lens 19 as image signals. The read image signals are digitalized, and subjected to image processing so that processed data can be printed.

Further, the image forming apparatus 100 may externally receive image data (i.e. print data) of an image to be formed by the image forming unit 2 from a host apparatus such as an information processing apparatus including a computer, an image scanning apparatus including a scanner, and an imaging apparatus including a digital camera via a cable or a network, and process and print the received image data.

As shown in FIGS. 2 and 3, the image forming unit 2 includes a guide rod 21, a guide rail 22, a carriage 23, recording heads 24, a main scanning motor 27, a drive pulley 28A, a driven pulley 28B, and a timing belt 29. One side of the carriage 23 is supported by the guide rod 21 and the guide rail 22 in such a manner that the carriage 23 can move in a main scanning direction indicated by an arrow A in FIG. 3. The carriage 23 moves to scan in the main scanning direction through the timing belt 29 stretched around the drive pulley 28A and the driven pulley 28B.

The recording heads 24 include a plurality of ink discharge heads for discharging respective colors of ink droplets. The recording heads 24 are mounted on the carriage 23. When the carriage 23 moves in the main scanning direction, the recording heads 24 discharge ink droplets on the sheet 5 conveyed by the sub-scanning conveyance unit 3 in a sheet conveyance direction (i.e. sub-scanning direction) to form an image on the sheet 5, which is a so-called shuttle method.

The recording heads 24 include two ink discharge heads 24*k*1 and 24*k*2 for discharging black ink, and ink discharge heads 24*c*, 24*m*, and 24*y* for discharging cyan, magenta, and yellow ink, respectively. Hereinafter, black, cyan, magenta, and yellow are referred to as Bk, C, M, and Y, respectively when necessary. The ink discharge heads 24*k*1, 24*k*2, 24*c*, 24*m*, and 24*y* are collectively referred to as the recording heads 24. The carriage 23 includes a plurality of sub-tanks 25 for supplying respective colors of liquid ink to the respective recording heads 24.

The sub-tanks 25 are supplied with the respective colors of liquid ink from respective ink cartridges 26 which contain the respective colors of liquid ink, and are located at a left side in the main unit 1 as shown in FIG. 2. The respective ink cartridges 26 are removably loaded to the main unit 1 from a front side thereof. Two of the plurality of the sub-tanks 25 and one of the ink cartridges 26 are used for the black ink, and the two sub-tanks 25 are supplied with the black ink from the one of the ink cartridges 26.

The recording heads 24 include a pressure generation mechanism (i.e. actuator mechanism) for pressurizing ink in an ink flow path (i.e. pressure generation chamber). The pressure generation mechanism may be of a so-called piezo type, a thermal type, or an electrostatic type. The piezo type pressure generation mechanism discharges ink droplets by deforming a vibration plate which forms a wall of the ink flow path by using a piezoelectric element to change the inner volume of the ink flow path. The thermal type pressure generation mechanism discharges ink droplets by means of pressure by heating ink in the ink flow path by using a heat-generating resistance body to generate bubbles. The electrostatic type pressure generation mechanism discharges ink droplets by arranging a vibration plate which forms a wall of the ink flow path and an electrode at respective opposing positions so that static electricity is generated between the vibration plate and the electrode and the vibration plate is deformed by the generated static electricity to change the inner volume of the ink flow path.

As shown in FIG. 3, the image forming apparatus 100 further includes a maintenance and recovery mechanism 121 for maintaining and recovering respective states of nozzles of the recording heads 24. The maintenance and recovery mechanism 121 is arranged in a non-print area located at one end in the main scanning direction of the carriage 23 (i.e. at a back side of the main unit 1). The maintenance and recovery mechanism 121 includes five moisture-retentive caps 122*k*2, 122*k*1, 122*c*, 122*m*, and 122*y* (hereinafter referred to as moisture-retentive caps 122 when the colors do not need to be distinguished), a suction cap 123, a wipe blade 124, a receive member 125, and so forth. The moisture-retentive caps 122 are placed on respective nozzle faces of the recording heads 24. The wipe blade 124 wipes the nozzle faces of the recording heads 24. The receive member 125 receives ink droplets injected for a non-recording purpose.

Further, as shown in FIG. 3, the image forming apparatus 100 further includes another receive member 126 for receiving ink droplets injected for a non-recording purpose. The receive member 126 is arranged in a non-print area located at another end in the main scanning direction of the carriage 23 (i.e. at a front side of the main unit 1). The receive member 126 includes five openings 127*k*2, 127*k*1, 127*c*, 127*m*, and 127*y* (hereinafter referred to as openings 127 when the colors do not need to be distinguished) for the respective recording heads 24.

As shown in FIG. 2, the sub-scanning conveyance unit 3 includes a conveyance belt 31, a conveyance roller 32, a driven roller 33, a charge roller 34, a guide member 35, two pressing rollers 36, two spur rollers 37, and a separation pawl 38. The conveyance belt 31 is an endless belt stretched around the conveyance roller 32 and the driven roller 33. The conveyance roller 32 is a drive roller. The driven roller 33 is a tension roller. The charge roller 34 includes a charge mechanism for charging a surface of the conveyance roller 31 by applying a high voltage which is an alternating voltage from a high voltage power source. The guide member 35 guides the conveyance belt 31 in an area opposing the image forming unit 2. The two pressing rollers 36 press the sheet 5 onto the conveyance belt 31 at a position opposing the conveyance roller 32. The two spur rollers 37 press a top face of the sheet 5 having an image formed thereon by the image forming unit 2. The separation pawl 38 separates the sheet 5 having the image thereon from the conveyance belt 31.

The sub-scanning conveyance unit 3 shifts the conveyance direction of the sheet 5 upwardly-fed at a substantially right angle so that the sheet 5 is conveyed while opposing the image forming unit 2.

As shown in FIG. 3, the image forming apparatus 100 further includes a sub-scanning motor 131, a timing belt 132, and a timing roller 133.

The conveyance belt 31 in the sub-scanning conveyance unit 3 is configured such that the sub-scanning motor 131 causes the conveyance roller 32 to rotate via the timing belt 132 and the timing roller 133 in the sheet conveyance direction (i.e. the sub-scanning direction) indicated by an arrow B in FIG. 3. The conveyance belt 31 includes two layers including, for example, a front layer which is formed of a pure resin material which has not been subjected to resistance control, such as an ETFE pure material, and serves as a sheet attraction surface, and a back layer formed of a material which is the same as the material of the front layer except that the material has been subjected to resistance control by using carbon (i.e. a medium-level resistive layer or a ground layer). Alternatively, the conveyance belt 31 may include a single layer. Alternatively, the conveyance belt 31 may include more than three layers.

As shown in FIG. 2, the sheet feeding unit 4 includes a sheet feeding cassette 41, a sheet feeding roller 42, a friction pad 43, and a pair of registration rollers 44. The sheet feeding unit 4 further includes a manual feed tray 46, a manual feed roller 47, a pair of conveyance rollers 48, an optional sheet feeding cassette (not shown), and a sheet feeding motor 49 (i.e. a drive mechanism).

The sheet feeding cassette 41 is removably loaded into the main unit 1 from a front side thereof, and stores sheets including the sheet 5. The sheet feeding roller 42 and friction pad 43 carry out and convey the sheet 5 after separating the sheet 5 from rest of the sheets in the sheet feeing cassette 41. The pair of registration rollers 44 registers the conveyed sheet 5.

The manual feed tray 46 stores sheets including the sheet 5. The manual feed roller 47 feeds the sheets in manual feed tray 46, one after another. The optional sheet feeding cassette may be loaded into a lower part of the main unit 1. The pair of conveyance rollers 48 conveys the sheet 5 fed from the duplex unit 10 described below. The sheet feeding motor 49 includes an HB-type stepping motor, and drives members for feeding the sheet 5 to the sub-scanning conveyance unit 3 including the sheet feeding roller 42, the pair of registration rollers 44, the manual feed roller 47, and the pair of conveyance rollers 48 via an electromagnetic clutch (not shown) to rotate.

The sheet conveyance unit 7 includes a conveyance path 70, three conveyance rollers 71*a*, 71*b*, and 71*c* (hereinafter referred to as conveyance rollers 71 as necessary), spurs 72*a*, 72*b*, and 72*c* (hereinafter referred to as spurs 72 as necessary), a lower guide 73, and an upper guide 74. The sheet conveyance unit 7 further includes a reverse discharge path 81, a pair of reverse rollers 77, and a pair of reverse discharge rollers 78

The spurs 72*a*, 72*b*, and 72*c* are located in positions opposing to the conveyance rollers 71*a*, 71*b*, and 71*c*, respectively, and convey the sheet 5. The lower guide 73 and the upper guide 74 guide the sheet 5 conveyed between the conveyance rollers 71 and the spurs 72. The conveyance path 70 is located between the lower guide 73 and the upper guide 74. The reverse discharge path 81 is a first conveyance path, and is used for discharging the sheet 5 into the sheet discharge tray 8. The pair of reverse rollers 77 and the pair of reverse discharge rollers 78 carry out the sheet 5 conveyed from the lower guide 73 and the upper guide 74 to the sheet discharge tray 8 through the reverse discharge path 81 with a first face down.

The sheet conveyance unit 7 further includes a branch mechanism 60, a discharge path 82, and a straight discharge tray 181.

The discharge path 82 is a second conveyance path, and is used for discharging the sheet 5 into the straight discharge tray 181 described below. The branch mechanism 60 is located at an exit side of the conveyance path 70. The branch mechanism 60 is a selector for switching a conveyance direction of the sheet 5 among the reverse discharge path 81, the discharge path 82, and the duplex unit 10.

The duplex unit 10 includes a vertical conveyance mechanism 101*a*, a horizontal conveyance mechanism 101*b*, and a branch plate 96. The vertical conveyance mechanism 101*a* and the horizontal conveyance mechanism 101*b* are integrally formed. The vertical conveyance mechanism 101*a* includes a vertical conveyance path 90*c* for receiving the sheet 5 carried at one side of the main unit 1 and downwardly conveying the sheet 5. The horizontal conveyance mechanism 101*b* includes a horizontal conveyance path 90*a* and a switchback conveyance path 90*b* for conveying the sheet 5 following the vertical conveyance path 90*c* in a horizontal direction.

The vertical conveyance path 90*c* includes a pair of entry rollers 91 and a pair of conveyance rollers 92. The horizontal conveyance path 90*a* includes five pairs of conveyance rollers 93. The switchback conveyance path 90*b* includes a pair of exit rollers 94 and three pairs of conveyance rollers 95 which include respective reverse rollers.

The pair of entry rollers 91 downwardly conveys the sheet 5 carried into the vertical conveyance path 90*c*. The pair of conveyance rollers 92 carries out the sheet 5 into the horizontal conveyance path 90*a*. The pairs of exit rollers 94 and conveyance rollers 95 reverse the sheet 5 for re-feeding. The branch plate 96 is swingably arranged between a switchback position indicated by a dotted line in FIG. 2 and a re-feeding position indicated by a solid line in FIG. 2. When the branch plate 96 is in the switchback position, the sheet 5 is conveyed from the horizontal conveyance path 90*a* to the switchback conveyance path 90*b*. When the branch plate 96 is in the re-feed position, the sheet 5 is conveyed from the switchback conveyance path 90*b* and is carried out of the duplex unit 10. The sheet 5 carried out of the duplex unit 10 is conveyed to the pair of conveyance rollers 48 and the pair of registration rollers 44.

The image forming apparatus 100 further includes an open and close guide plate 190. When the sheet 5 fed from one of the sheet feeding cassette 41, the manual feed tray 46, and the duplex unit 10 is conveyed by the pair of registration rollers 44, the sheet 5 may have backward tension between a first position between the conveyance roller 32 of the sub-scanning conveyance unit 3 and the pressing rollers 36 and a second position between the pair of registration rollers 44. The open and close guide plate 190 is swingably arranged in a position shown in FIG. 2, and allows the sheet 5 to slack so that the sheet 5 is prevented from having the backward tension. The open and close guide plate 190 swings in a direction of an arrow S shown in FIG. 2 from the position illustrated in FIG. 2 to guide the sheet 5 when the sheet 5 is conveyed from the pair of registration rollers 44 to the sub-scanning conveyance unit 3. The open and close guide plate 190 swings back to the position illustrated in FIG. 2 when the sheet 5 arrives at the sub-scanning conveyance unit 3 to allow the sheet 5 to slack.

The image forming apparatus 100 further includes a single manual feed tray 141. The single manual feed tray 141 is located at one side of the main unit 1, and is openably provided to the main unit 1. The single manual feed tray 141 is opened into a position indicated by a chain double-dashed line when the sheet 5 is singularly fed. The sheet 5 singularly fed from the single manual feed tray 141 is guided by an upper face of the open and close guide plate 190 so that the sheet 5 is straightly carried into the first position between the conveyance roller 32 and the pressing rollers 36.

The image forming apparatus 100 further includes the straight discharge tray 181 for discharging the sheet 5 with the first face up. The straight discharge tray 181 is located at another side of the main unit 1, and is openably provided to the main unit 1. The sheet 5 carried out by the upper guide 73 and the lower guide 74 in the sheet discharge unit 7 is straightly discharged to the straight discharge tray 181 through the discharge path 82.

When the sheet 5 has a large thickness and is difficult to convey in a curved path, the sheet 5 may be fed from the single manual feed tray 141 and straightly conveyed to the straight discharge tray 181.

An image forming operation performed by the image forming apparatus 100 having the above configuration is briefly described below.

An alternating current bias supply unit (not shown) applies a high voltage having a negative and positive rectangular wave (i.e. alternating voltage) to the charge roller 34. As the charge roller 34 contacts an insulating layer (i.e. the front layer) of the conveyance belt 31, positive and negative charge is alternately applied to the front layer of the conveyance belt 31 in a belt-like shape along the conveyance direction. The conveyance belt 31 is charged with a predetermined change width, and an unequal electric field is formed thereon.

The sheet 5 is fed from one of the sheet feeding unit 4, the manual feed tray 46, the duplex unit 10, the single manual feed tray 141, and so forth. When the sheet 5 is conveyed to the first position between the conveyance roller 32 and the pressing rollers 36 on the conveyance belt 31 where the unequal electric field is generated by the positive and negative charge formed thereon, the sheet 5 is immediately polarized along the direction of the electric field, and attracted to the conveyance belt 31 by the attraction force of static electricity so that the sheet 5 is conveyed as the conveyance belt 31 moves.

While the sheet 5 is intermittently conveyed by the conveyance belt 31, ink droplets are discharged from the recording heads 24 according to print data onto the sheet 5 to form an image. A front end of the sheet 5 having the image formed thereon is separated from the conveyance belt 31 by the separation pawl 38 so that the sheet 5 is discharged to one of the sheet discharge tray 8 and the straight discharge tray 181 by the sheet conveyance unit 7, or is conveyed to the duplex unit 10. When the sheet 5 is conveyed to the duplex unit 10, an image is formed on another side of the sheet 5, and the sheet 5 is discharged.

Figure 4A:
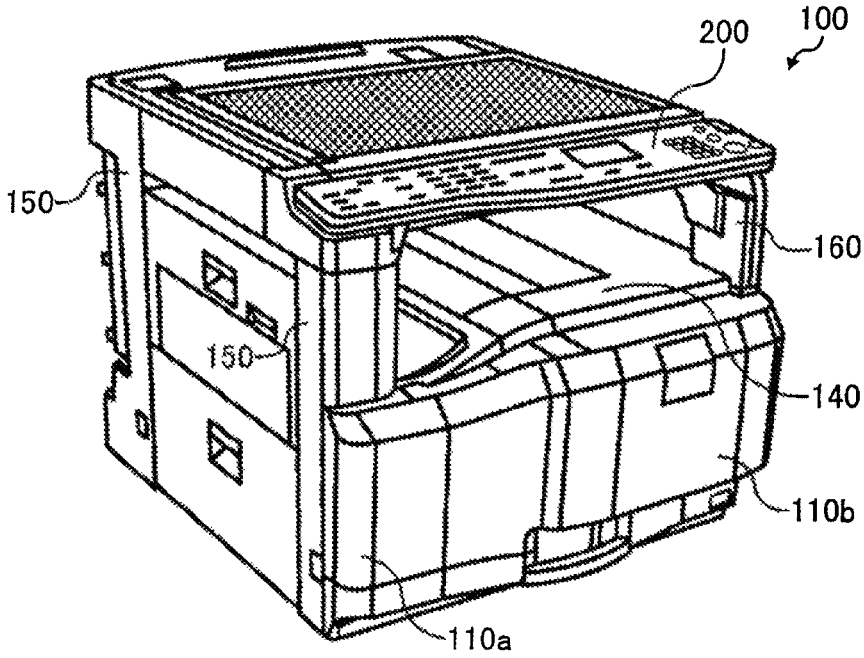
FIGS. 4A and 4B show perspective views of the image forming apparatus with a user operation door and a maintenance service door closed.
Figure 4B:
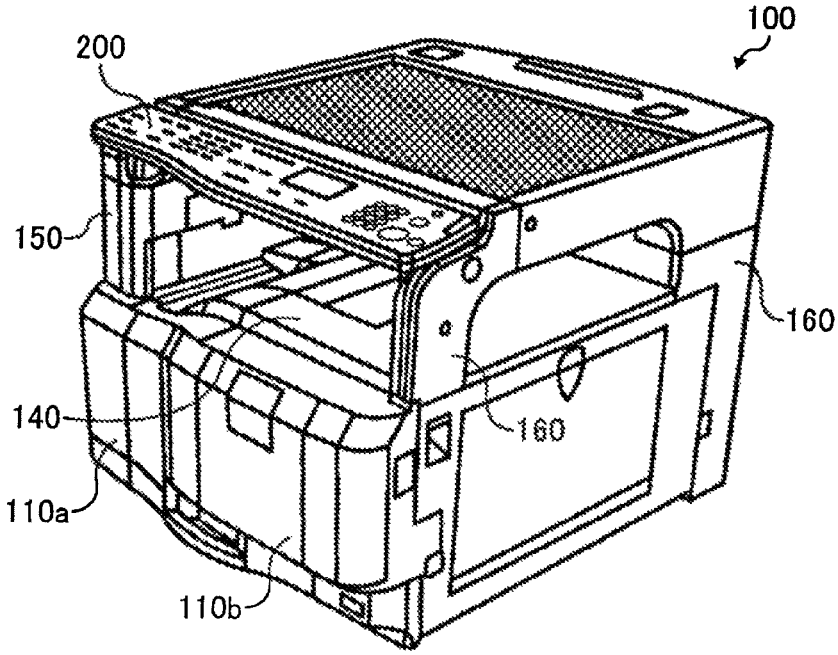
Figure 5A:
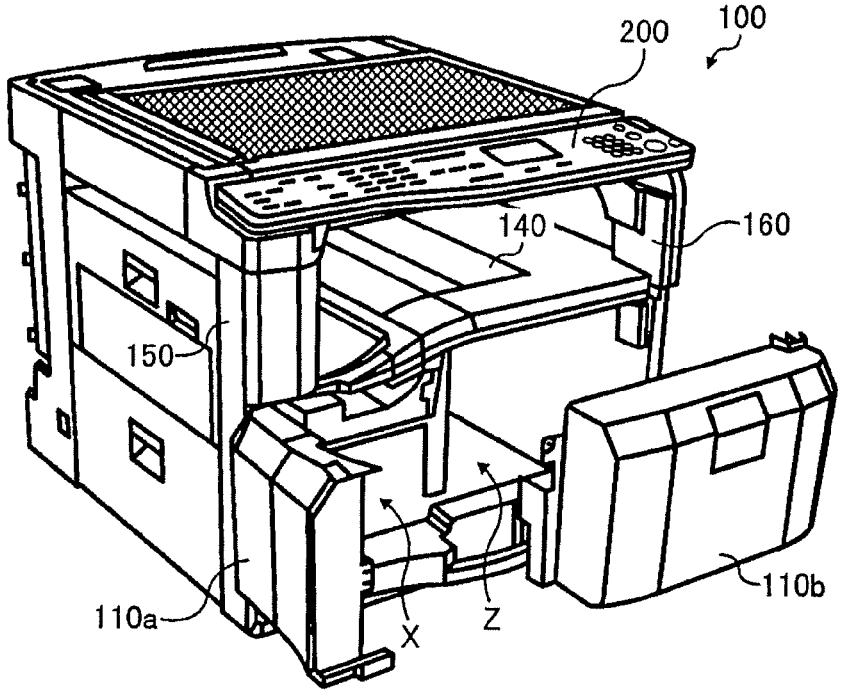
FIGS. 5A and 5B show perspective views of the image forming apparatus with the user operation door and the maintenance service door opened.
Figure 5B:
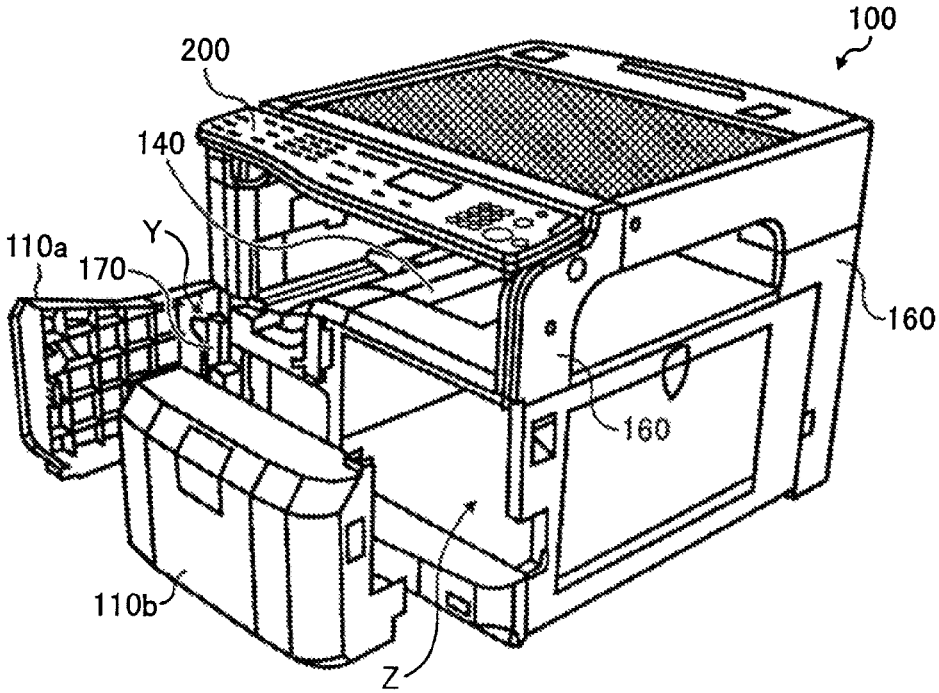

FIGS. 4A and 4B show perspective views of the image forming apparatus 100 with the user operation door 110*a* and the maintenance service door 110*b* closed. FIGS. 5A and 5B show perspective views of the image forming apparatus 100 with the user operation door 110*a* and the maintenance service door 110*b* opened.

The image forming section 110 of the image forming apparatus 100 is smaller in size than a corresponding section of a background electrophotographic image forming apparatus. As shown in FIGS. 4A and 4B, the user operation door 110*a* and the maintenance service door 110*b* vertically divide a front face of the main unit 1. The user operation door 110*a* attached to the main unit 1 is configured such that a user is able to open and close the user operation door 110*a*. The maintenance service door 110*b* attached to the main unit 1 is configured such that it is difficult for the user to remove the maintenance service door 110*b* from the main unit 1.

In detail, as shown in FIGS. 5A and 5B, the user operation door 110*a* is located at a left side of the main unit 1 so that the user is able to access components such as the ink cartridges 26 (shown in FIG. 2) which are ordinarily replaced by the user. The user operation door 110*a* covers a section X in FIG. 5A when closed. The user operation door 110*a* is swingably attached to a frame 170 of the main unit 1 with a hinge or the like so that the user is able to easily open and close the user operation door 110*a*. The user operation door 110*a* is mounted at a position Y shown in FIG. 5B.

The maintenance service door 110*b* is fitted into the frame 170 so that it is difficult for the user to attach and detach the maintenance service door 110*b* from the main unit 1. Alternatively, the maintenance service door 110*b* is attached to the frame 170 with a screw so that it is difficult for the user to attach and detach the maintenance service door 110*b* from the main unit 1. The maintenance service door 110*b* covers a front side of a section Z, where the image forming section 110 and so forth are placed (not shown), in FIGS. 5A and 5B when closed. As shown in FIGS. 5A and 5B, components located in the section Z are relatively small in size compared with the maintenance service door 110*b* for covering the section Z. Therefore, having the maintenance door 110*b* configured such that it is difficult for the user to attach and detach the maintenance door 110*b* from the main unit 1 is helpful.

Figure 6:
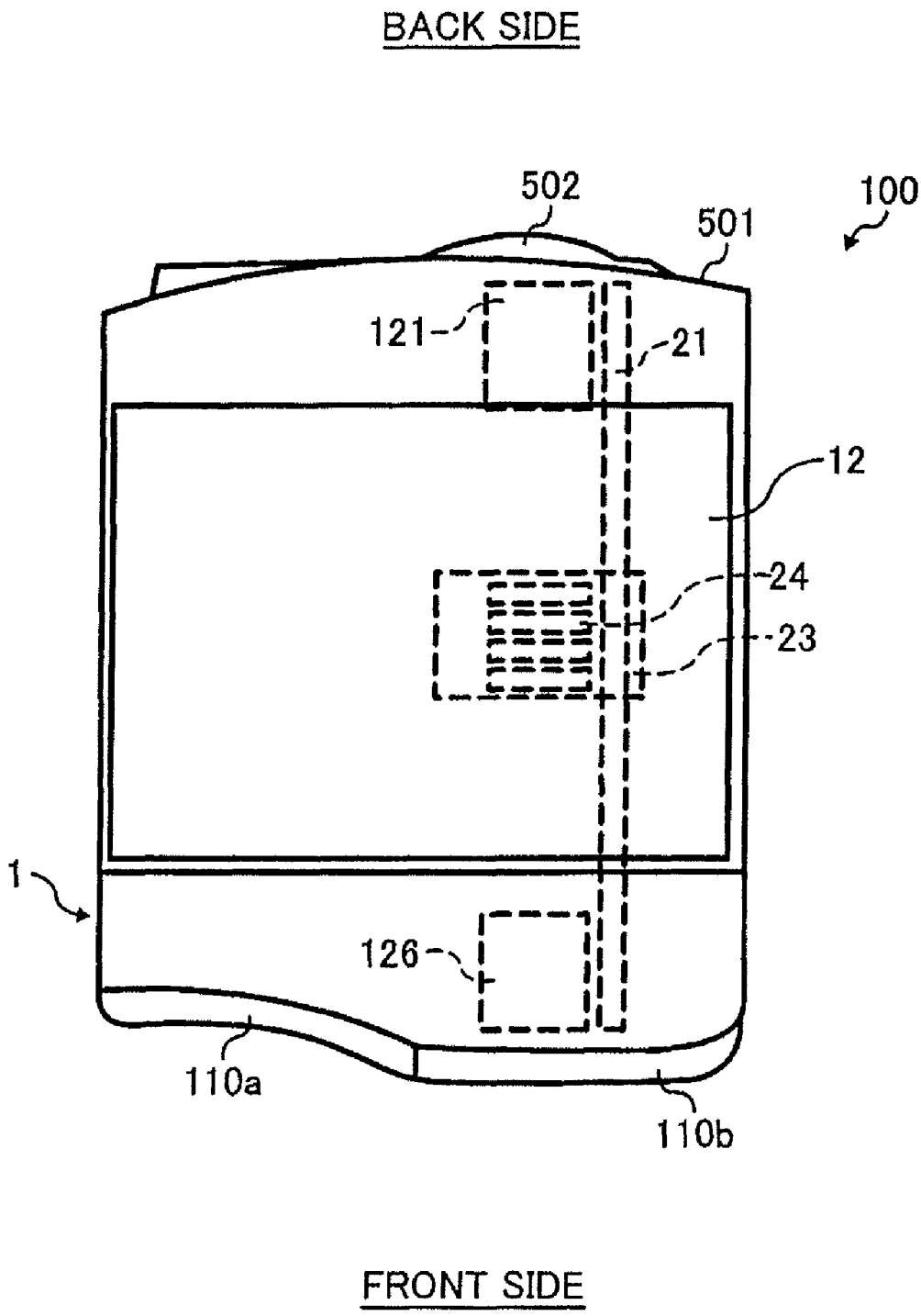
FIG. 6 is a plan view of the image forming apparatus for explaining planar shapes of the user operation door and the maintenance service door.

FIG. 6 is a plan view of the image forming apparatus 100 for explaining planar shapes of the user operation door 110*a* and the maintenance service door 110*b*. As shown in FIG. 6, the maintenance service door 110*b* covering the receive member 126 of an engine unit projects outward compared with the user operation door 110*a*. In other words, the user operation door 110*a* covering the ink cartridges 26 is recessed compared to the maintenance service door 110*b*.

The image forming apparatus 100 performs serial scanning which requires maintenance and recovery of the recording heads 24. As described above, the maintenance and recovery mechanism 121 and the receive member 126 are needed for performing maintenance and recovery of the recording heads 24. The width of a scanning area of the carriage 23 needs to be larger than the width of the sheet 5. Therefore, when the carriage 23 is configured to scan in frontward and backward directions of the main unit 1, the receive member 126, for example, may be arranged at a front side, and the maintenance and recovery mechanism 121, for example, may be arranged at a back side.

When the front face of the image forming apparatus 100 is shaped according to the shape of a front end of the receive member 126, the image forming apparatus 100 has an unnecessary space at a front side of the ink cartridges 26 arranged at a left side of the image forming apparatus 100. As a result, the main unit 1 has a large size, occupies a large space for installation, and looks relatively larger.

Therefore, the user maintenance door 110*a* is recessed so that the image forming apparatus has a smaller size, occupies a smaller space for installation, and is provided with an appearance of smaller depth. Further, the user operation door

110*a* and the maintenance service door 110*b* have geometry with smooth curves so that the user operation door 110*a* and the maintenance service door 110*b* are visually recognized as small.

Further, when a back face 501 of the image forming apparatus 100 is shaped according to the shape of a back end of the maintenance and recovery mechanism 121, a part 502 of the back face 501 covering the image forming unit 2 backwardly projects. As a result, the main unit 1 looks relatively larger.

Therefore, the back face 501 is configured to have curves so that the part 502 does not remarkably project compared with the back face 501.

The present invention is not limited to the configuration described above.

Further, the present invention is not limited to the image forming apparatus 100 which adopts the gel ink jet method and discharges the sheet 5 inside the main unit 1. Alternatively, the image forming apparatus 100 may adopt a general ink jet method, and may discharge the sheet 5 outside the main unit 1.

This patent specification is based on Japanese patent application, No. JP2005-367510 filed on Dec. 21, 2005 in the Japan Patent Office, the entire contents of which are incorporated by reference herein.

The invention claimed is:

1. An image forming apparatus for forming an image on a recording medium, comprising:

a main unit including an image forming mechanism configured to form an image and a replaceable component configured to be ordinarily replaced by a user;

a first door attached to a front side of the main unit with a first attachment mechanism, wherein the first door is openable and closable;

a second door attached to the front side of the main unit with a second attachment mechanism to vertically divide the front side of the main unit such that the first door and the second door do not overlap in a vertical direction, and the first attachment mechanism is different from the second attachment mechanism; and a third door located on a side adjacent to the front side of the main unit on which the first door and the second door are located, and the recording medium is fed to the image forming mechanism through the third door, wherein the first door is recessed into the main unit such that the second door extends outwardly from the main unit further than the first door and a portion of the image forming mechanism in the main unit is concealed by the second door and extends outwardly from the main unit further than a portion of an outer face of the first door.

2. The image forming apparatus according to claim 1, wherein the first door is located in a position such that the replaceable component is accessible from outside of the image forming apparatus via the first door.

3. The image forming apparatus according to claim 1, wherein the second door is provided for maintenance service.

4. The image forming apparatus according to claim 3, wherein the second door is attached to the main unit with the second attachment mechanism, and the second attachment mechanism is a mechanism for preventing the second door from being easily detached from the main unit.

5. The image forming apparatus according to claim 4, wherein the second attachment mechanism is a fixing member.

6. The image forming apparatus according to claim 1, wherein the second door is located in a position such that the second door covers a front side of the image forming mechanism in the main unit.

7. The image forming apparatus according to claim 1, wherein the image forming mechanism located at a back side of the second door is relatively small in size compared to the second door.

8. The image forming apparatus according to claim 1, wherein the image forming mechanism utilizes an ink jet method.

9. The image forming apparatus according to claim 1, wherein the first door is located adjacent to the second door.

10. The image forming apparatus according to claim 1, wherein the second attachment mechanism includes at least one screw.

11. The image forming apparatus according to claim 1, wherein the first door is located on a left side of the front side of the main unit and the second door is located to a right of the first door.

* * * * *